US005199959A

United States Patent [19]

Sung et al.

[11] Patent Number: 5,199,959

[45] Date of Patent: Apr. 6, 1993

[54] COMPOSITION OF MATTER FOR FULL AND PARTIAL CALIX[8]ARENE ENCAPSULATION OF S-TRIAZINES FOR THERMAL STABILITY ENHANCEMENT AND DISSOLUTION IN DIESEL FUEL

[75] Inventors: Rodney L. Sung, Fishkill, N.Y.; Thomas F. Derosa, Passaic, N.J.; Benjamin J. Kaufman, Hopewell Jct., N.Y.

[73] Assignee: Texaco Inc., White Plains, N.Y.

[21] Appl. No.: 848,474

[22] Filed: Mar. 9, 1992

[51] Int. Cl.[5] ..... C10L 1/22

[52] U.S. Cl. ..... 44/336; 544/215

[58] Field of Search ..... 44/336; 544/215

[56] References Cited

U.S. PATENT DOCUMENTS 3,763,094 10/1973 Knell et al. ..... 44/336

5,114,608 5/1992 Cook et al. ..... 252/25

*Primary Examiner*—Jacqueline Howard

*Attorney, Agent, or Firm*—James J. O'Loughlin; Vincent A. Mallare

[57] ABSTRACT

A method has been developed to solubilize hydroxy S-triazines containing at least one hydroxy function in diesel fuel and to enhance their overall thermal stability. The products which result from the full or partial encapsulation of hydroxy-S-triazine with calix[8]arene have unique and novel properties and reduce or eliminate nitrogen oxides level in diesel fuel.

2 Claims, No Drawings

COMPOSITION OF MATTER FOR FULL AND PARTIAL CALIX[8]ARENE ENCAPSULATION OF S-TRIAZINES FOR THERMAL STABILITY ENHANCEMENT AND DISSOLUTION IN DIESEL FUEL

BACKGROUND OF THE INVENTION

This invention relates to a chemical method of decreasing nitric oxide, NOx, levels, and more particularly to a composition of matter for reducing $NO_x$ levels in diesel fuels.

Nitrogen oxides are the oxidation products of elemental nitrogen, organic or inorganic nitrogen and oxygen at elevated temperatures. Nitrogen oxides include nitric oxide, NO; nitrogen dioxide, $NO_2$; nitrogen trioxide, $NO_3$; dinitrogen trioxide, $N_2O_3$; tetranitrogen pentaoxide, $N_4O_5$; tetranitrogen hexaoxide, $N_4O_6$; nitrous oxide, $N_2O$; and the like. Elevated temperatures required to prepare these oxidation products are routinely obtained in internal combustion engines utilizing gasoline, diesel, or aviation fuel.

There are ecological and environmental reasons to reduce or ideally eliminate NOx as an internal combustion oxidation product. Once produced, NOx is directly responsible for acid rain and photochemical smog. Moreover, chronic exposure to NOx has been directly linked with restricted pulmonary compliance in nonsmoking healthy males; acute respiratory disease among children living in "high exposure" towns in Czechoslovakia; and a key irritant cited for the high incidence of chronic bronchitis among Japanese postal workers servicing urban centers as outlined in Medical and Biologic Effects of Environmental Pollutants by the National Academy of Sciences, 1977.

Numerous and physical methods have been suggested to reduce or eliminate NOx. Certain proposed techniques involve a great deal of capital outlay and require major consumption of additives, scrubbers, etc. For example, U.S. Pat. No. 3,894,141 proposes a reaction of $NO_x$ with liquid hydrocarbons; U.S. Pat. No. 4,405,587 proposes high temperature burning of $NO_x$ with a hydrocarbon; U.S. Pat. No. 4,448,899 proposes reacting of $NO_x$ with an iron chelate; and U.S. Pat. No. 3,262,751 reacts NOx with a conjugated diolefin.

Utilizing these inventions, discussed above, entails organic pollutant disposal problems along with the attendant problems of toxicity and malodorous environments. In addition, they require the presence of oxygen and are relatively expensive.

Thus, an object of the present invention is to provide an economical means and/or composition of matter that effectively reduces the $NO_x$ in diesel fuel exhausts.

DISCLOSURE STATEMENT

U.S. Pat. No. 4,731,231 discloses a method of reducing NOx levels for stationary sources of NOx such as power plants utilizing fossil fuel. However, this invention is limited to stationary $NO_x$ sources only. This invention is not applicable to dynamic or non-stationary $NO_x$ sources, for example, gasoline or diesel powered vehicles, which means that a method for $NO_x$ reduction was not achieved.

Japanese Publication No. J550551-420 utilizes haolcyanuric acid to remove malodorous fumes, e.g., mercaptans, sulfides, disulfides, ammonia or amines from gases by contact therewith followed by contact with activated carbon. Temperatures are reported in this publication as less than 80° C.; and classical acid/base interactions appear to be involved (not pyrolysis decomposition products of the haolcyanuric acid).

Back et al., Can. J. Chem. 46.531(1968), disclose the effect of No on the photolysis of HNCO, the decomposition product of cyanuric acid. An increase of nitrogen concentration in the presence of large amounts of nitric oxide was observed utilizing a medium pressure mercury lamp for photolysis of HNCO. The increased concentration of nitrogen was associated by the authors with deduction of NO load by HNCO.

Furthermore, use of cyanuric acid as a source of isocyanic acid (HNCO) for purposes of studying various properties of the latter of its subsequent degradation products is also known. See, for example, Okable, J. Chem. Phys., 53,3507 (1970) and Perry J. Chem. Phys., 82,5485 (1985). However, heretofore, it was never suggested that cyanuric acid could be useful in the removal of NO from non-stationary sources.

SUMMARY OF THE INVENTION

This invention provides a composition of matter comprising a mixture of: a) p-nonyl calix[8]arene-tri-hydroxyl-s-triazine; b) (p-nonyl calix[8]arene)ether-di-hydroxyl-s-triazine; c) (p-nonyl-calix[8]arene)diether-hydroxyl-s-triazine; d) (p-nonyl-calix[8]arene)triether-s-triazine; e) (p-phenyl-co-p-nonyl-calix[8]arene-tri-hydroxyl-s-triazine; f) p-phenyl-co-p-nonyl-calix[8]arene)-dihydroxyl-s-triazine; g) (p-phenyl-c-p-nonyl-calix[8]arene)diether-s-triazine; h) (phenyl-co-p-nonyl-calix[8]-arene)triether-hydroxyl-s-triazine; i) di(p-nonyl-calix[8]arene)diether-hydroxyl-triazine; j) (p-nonyl-calix[8]arene)ether-di-(p-nonyl-calix[8]arene)'-diether-s-triazine; k) di(p-phenyl-c-p-nonyl-calix[8]arene)diether-hydroxyl-s-triazine; l) (p-phenyl-co-p-nonyl-calix[8]arene)ether-di(p-phenyl-co-p-nonyl-calix[8]arene)'diether-s-triazine; m) tri-(p-nonyl-calix[8]arene)triether-s-triazine; n) tri(p-phenyl-co-p-nonyl-calix[8]arene)triether-s-triazine; o) [(p-nonyl-calix[8]arene)-(hydroxyl-s-triazine)]copolyether; p) [(p-phenyl-co-p-nonyl-calix[8]arene)-(hydroxyl-s-triazine)]-copolyether; q,) [(p-nonyl-calix[8]arene)-(s-triazine)]-starpolyether; and r) [(p-phenyl-co-p-nonyl-calix[8]arene)-(s-triazine)]starpolyether.

DETAILED DESCRIPTION OF THE INVENTION

The composition of matter of this invention is directed to the solubilization of cyanuric acid and its derivatives in diesel fuel; and the thermal enhancement of the same in order to survive the internal engine combustion event.

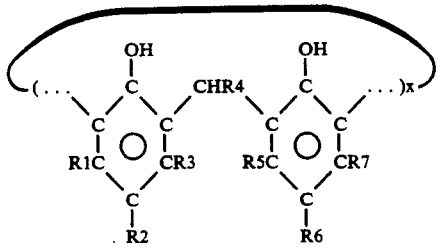

Calix[8]arene

A more complete disclosure of these and other substituents are provided below. For simplicity and clarity, however, wherever possible calix[8]arene (Ia) will be represented by an abbreviated structure (IB) shown below.

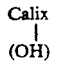

(Ib)

The partial or full encapsulation of hydroxyl-s-triazines by co- or homo-calix[8]arenes dramatically alters the solubility properties of the triazine. Moreover, by selecting high thermally stable calix[8]arenes monomer precursors, extraordinary thermal stability could be imparted to the calix[8]arene itself.

Although the partial or full incorporation of hydroxyl-s-triazines into a calix[8]arene matrix is essentially random, the unique chemical environment of the cavity itself will dramatically influence its NOx reducing strength. Specifically, a crucial chemical requirement of cyanuric acid or hydroxyl-s-triazine incorporation is that at least one, and preferably two, free hydroxyl groups must be present. The chemical underpinning for this requirement is that upon thermal unzipping free hydroxyl groups on s-triazine will generate the NOx reducing agent, isocyanic acid, HNCO.

Depicted below in Equations (Eq.) 1a, 1b, 1c and 1d are four encapsulations for triazines undergoing thermal decomposition.

Eq. 1a

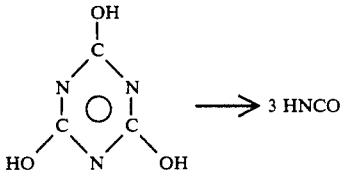

Eq. 1b

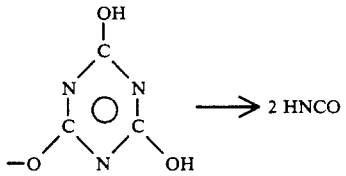

Eq. 1c

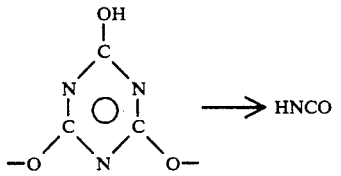

Eq. 1d

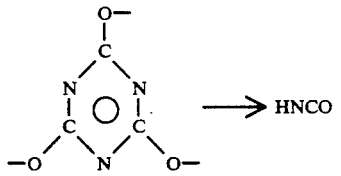

It is readily apparent the crucial role hydrogen atoms play in the generation of isocyanic acid. In addition to solubility and thermal stability enhancement, full or partial encapsulation within a calix [8]arene cavity offer chemical benefits. Firstly, full or partial encapsulation of s-triazines into the hydrophilic calix[8]arene cavity can provide a readily available supply of labile hydrogen atoms. Moreover, prior to an actual thermal decomposition, ortho-alkyl substituted phenolics routinely undergo 'ortho-quinone methide' while para-alkyl substituted phenolics undergo 'para-quinone methide' thermal rearrangements as illustrated below in Equation (Eq.) (2a) and (2b).

Eq. 2a

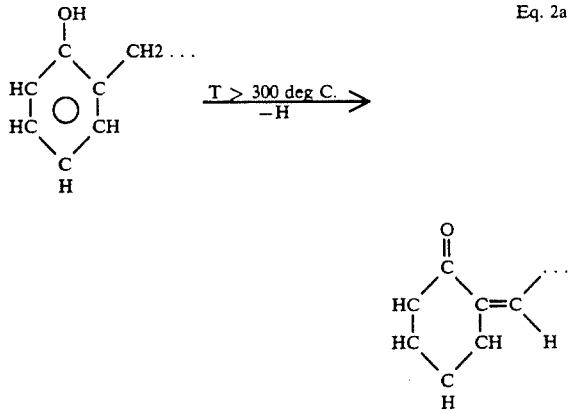

Eq. 2b

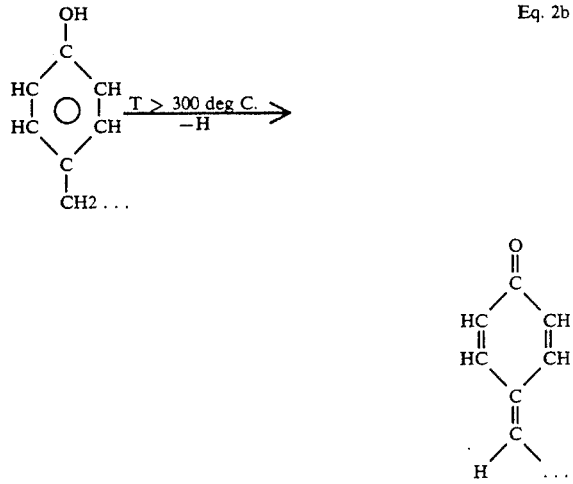

In both cases, acidic phenolic protons become available to augment the proton deficiency of triether-s-triazines to generate isocyanic acid, HNCO. During thermal degradation of calix [8]arenes, the encapsulator (host) will undergo degradation before its cavity contents (guest). This thermally-induced chemical process will essentially transform the calix[8]arene cavity center into a hydrogen atom 'sink' or repository.

According to the present invention, a chemical method has been developed to solubilize reducing agent precursors in diesel fuel and to enhance their overall thermal stability. Upon thermal decomposition, the reducing agent precursors which generate isocyanic acid, HNCO, are generically depicted below in Equation 3. The reducing agent precursors are hydroxyl s-triazines containing at least one hydroxyl function.

Eq. 3

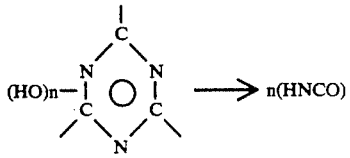

where n=1-3

The method of encapsulating hydroxyl-s-triazines (as illustrated below by structures II, III, and IV), so that both dissolution and thermal stability of the molecule enhanced in diesel fuel becomes possible, comprising the steps of:

a) reacting an s-triazine containing at least one hydroxyl group (II); an s-triazine containing a functionality which may chemically converted insitu into a hydroxyl group (III); or an s-triazine containing both a hydroxyl group and another functionality which may be chemically converted insitu into a hydroxyl group (IV); and an alkaline salt of calix[8]arene; and b) isolating and said separating reaction products from impurities generated therefrom said process.

Chemical s-triazines amenable to this process may be selected from those depicted below in formulas XVII, XVIII and IX). In all cases, the integer, n, may vary from 1 to 3.

(II)

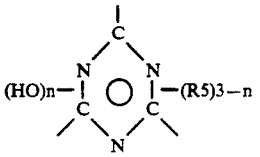

(III)

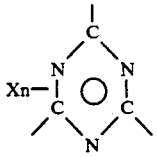

(IV)

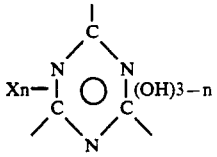

In the preceding formulas of II, III, and IV, R5 represents any inert non-reactive substituent. 'Non-reactive' shall mean non-reactive or inert to both the number of hydroxyl groups and to the chemical encapsulation process. It may be selected from the group consisting of $C_1$ to $C_{10}$ hydrocarbons that may be alkyl, aryl, linear or branched; or saturated or unsaturated. X represents any of the Group VIIa elements, although it is preferable to limit X to chlorine.

Calix[8]arenes that may be used in the present encapsulation process are generally represented below in formula (V).

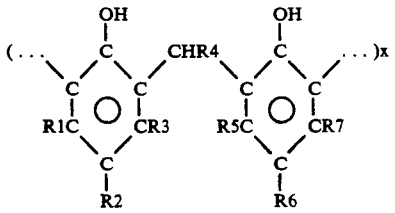

In the above formulas I(a) and (V), as well as formulas VI through XIV, the integer indicates the size of the calix[8]arene and varies from 6-60 for homo-calix[8]arenes or those calix[8]arenes that are derived using a single phenolic material. It is most preferable, however, to restrict x to 8. In the case of co-calix[8]arenes, i.e., those calixarenes derived using two phenolic materials, it is preferable to restrict the range of x from 2 to 10; and most preferable to limit x to 4. In formulas (Ia) and (V), above, and the following formulas, i.e., the reactant formula as well as the product formulas, (VI) through (XIV). R1, R2, R3, R5, R6, and R7 substituents enhance both the solubility and thermal properties of the calix[8]arene, and may be hydrogen or are a ($C_1$–$C_{50}$) hydrocarbon, including linear or branched aliphatic, or cycloaliphatic; or aliphatic cycloaliphatic groups; aromatic or polyaromatic; alkylaromatic and alkylpolyaromatic; saturated or unsaturated. They may also contain one or more heteroatoms as either an appendage or as part of one or more ring, cyclic or aromatic, structure. R4 is hydrogen or a ($C_1$–$C_{10}$) hydrocarbon. The hydrocarbon is preferably linear, but may also be branched; saturated or unsaturated; aromatic, polyaromatic, alkylaromatic, or alkylpolyaromatic.

The chemical method or process used to chemically encapsulate hydroxyl-s-triazines or derivatives which may be subsequently converted into hydroxyl-s- triazines and homo- or co-calixarenes is shown below in Equation (Eq.) 4. For illustrative purposes only, calix[8]arene is depicted as reacting with trichloro-s-triazine and subsequently encapsulating hydroxyl-s-triazine. The products generated by this method, are represented below by formulas VI through XIV.

Eq. 4.

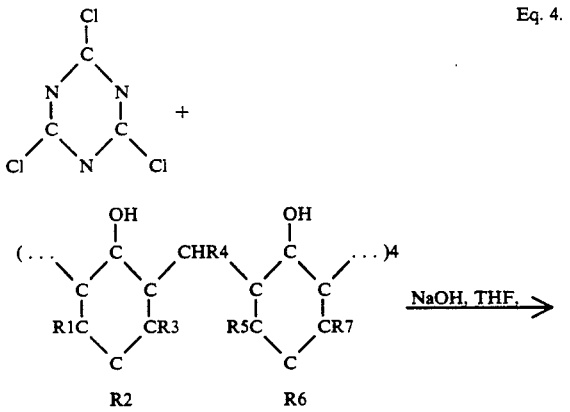

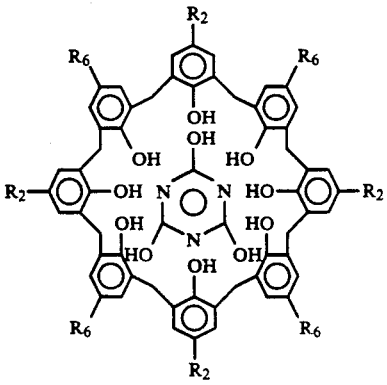

(VI)

-continued

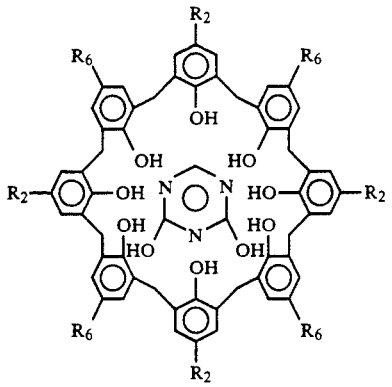

(VII)

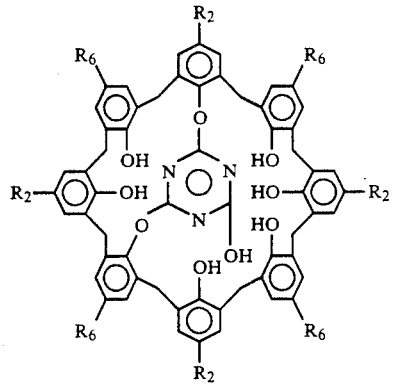

(VIII)

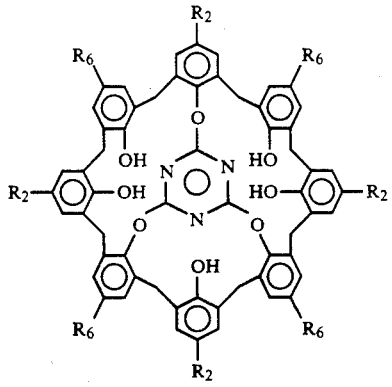

(IX)

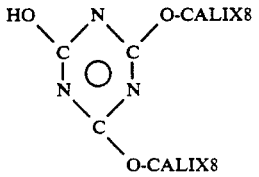

(X)

-continued

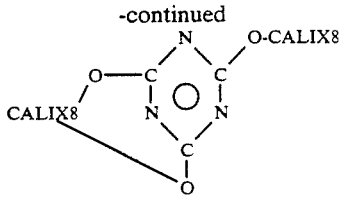

(XI)

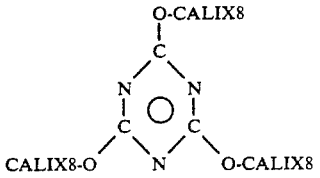

(XII)

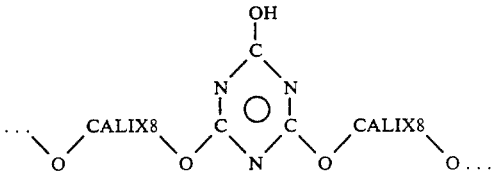

(XIII)

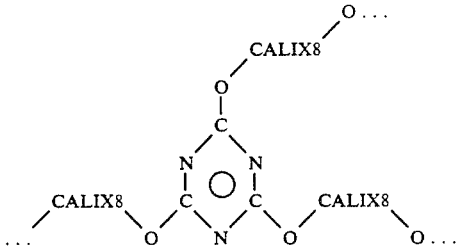

(XIV)

The products (i.e., components) which make up the composition of matter of the present invention, are represented in the above formulas VI through XIV. These products are identified, respectively, as follows: a) p-nonyl calix [8]arene-tri-hydroxyl-s-triazine; b) (p-nonyl calix[8]arene)ether-di-hydroxyl-s-triazine; c) (p-nonyl-calix[8]arene)diether-hydroxyl-s-triazine; d) (p-nonyl-calix[8]arene)triether-s-triazine; e) (p-phenyl-co-p-nonyl-calix[8]arene-tri-hydroxyl-s-triazine; f) p-phenyl-co-p-nonyl-calix[8]arene)-di-hydroxyl-s-triazine g) (p-phenyl-c-p-nonyl-calix[8]arene)diether-s-triazine; h) (phenyl-co-p-nonyl-calix[8]-arene)triether-hydroxyl-s-triazine; i) di(p-nonyl-calix[8]arene)diether-hydroxyl-s-triazine; j) (p-nonyl-calix[8]arene)ether-di-(p-nonyl-calix[8]arene)'diether-s-triazine; k) di(p-phenyl-c-p-nonyl-calix[8]arene)diether-hydroxyl-s-triazine; l) (p-phenyl-co-p-nonyl-calix[8]arene)ether-di(p-phenyl-co-p-nonyl-calix[8]arene)'diether-s-triazine; m) tri-(p-nonyl-calix[8]arene)triether-s-triazine; n) tri(p-phenyl-co-p-nonyl-calix[8]arene)triether-s-triazine; o) [(p-nonyl-calix[8]arene)-(hydroxyl-s-triazine)]copolyether; p) [(p-phenyl-co-p-nonyl-calix[8]arene)-(hydroxyl-s-triazine)]copolyether; q. [(p-nonyl-calix[8]arene)-(s-triazine)]starpolyether; and r) [(p-phenyl-co-p-nonyl-calix[8]arene)-(s-triazine)]starpolyether.

The above list of products (i.e., component a, b, c, etc.) are further identified below in Table I. In Table I, the products are further identified by listing the structure in which they are represented as well as identifying the $R_2$ and $R_6$ in the structure.

TABLE I

NOMENCLATURE AND CORRESPONDING STRUCTURE FOR SUBSTITUTED CALEX-ARENES

| NAME | STRUCTURE | $R_2$ | $R_6$ |
|---|---|---|---|
| a | VI | $C_9H_{19}$ | $C_9H_{19}$ |
| b | VII | $C_9H_{19}$ | $C_9H_{19}$ |
| c | VIII | $C_9H_{19}$ | $C_9H_{19}$ |
| d | IX | $C_9H_{19}$ | $C_9H_{19}$ |
| e | VI | $C_9H_{19}$ | Phenyl |
| f | VII | $C_9H_{19}$ | Phenyl |
| g | VIII | $C_9H_{19}$ | Phenyl |
| h | IX | $C_9H_{19}$ | Phenyl |
| i | X | — | — |
| j | XI | — | — |
| k | X | — | — |
| l | XI | — | — |
| m | XII | — | — |
| n | XII | — | — |
| o | XIII | — | — |
| p | XIII | — | — |
| q | XIV | — | — |
| r | XIV | — | — |

In order to further illustrate the present invention and its advantages, the following Examples are provided.

EXAMPLE 1

Preparation of p-nonyl-calix[8]arene

A three neck round bottom equipped with a magnetic stirrer, thermometer, and reflux condenser with a Dean-Stark adapter was charged with 30 parts p-n-nonylphenol, 400 parts, xylene, 1 part potassium hydroxide, and 8 parts paraformaldehyde and heated to reflux for 48 hours. Sufficient hydrochloride acid was added to neutralize the residue base and the mixture vacuum distilled to remove the unreacted reagents and solvent to provide the present prepared product. The resinous material; i.e., the present product was redissolved in xylene and precipitated in a copious amount of a 4:1 v/v methanol-water mixture, respectively.

EXAMPLE II

Preparation Of p-Phenyl-Co-p-Nonyl-Calix[8]arene

A 2.5 mole-mole ratio of p-phenylphenol and p-n-nonyl-phenol, respectively, should be substituted for the p-n-nonylphenol of Example 1, above, and the procedure thereof used herein to produce the prepared (i.e., reaction) product of this Example.

EXAMPLE III

Preparation Of p-Phenol-Co-o-Phenol-Calix[8]arene

A 1:5 mole-mole ratio of p-phenylphenol and p-n-nonyl-phenol, respectively, should be substituted for the p-n-nonylphenol of Example 1, above, and the procedure thereof used herein to produce the prepared (i.e., reaction) product of this Example.

EXAMPLE IV

Preparation Of p-Phenyl-Co-p-Nonylcalix[8]arene

A 5:1 mole-mole ratio of p-phenylphenol and p-n-nonyl-phenol, respectively, should be substituted for the p-n-nonylphenol of Example I, above, and the procedure thereof used herein to produce the prepared (i.e., reaction) product of this Example.

EXAMPLE V

Reaction Of P-n-Nonyl Calix[8]arene With Trichloro-s-Triazine

A 4-neck flask equipped with a magnetic stirrer, thermometer, reflux condenser, and addition funnel with a pressure equalizing arm was charged with 500 parts xylene, 2 parts water, and 150 parts p-n-nonylcalix[8]arene and 6 parts trichloro-s-triazine dissolved in anhydrous tetrahydrofuran were added dropwise. The mixture was refluxed for two hours, cooled to ambient temperature and filtered through cellulose filter paper to remove precipitated sodium chloride and solvent subsequently removed by atmospheric distillation to provide the present prepared product.

EXAMPLE VI

Reaction Of p-Phenyl-Co-p-Nonyl calix[8]arene With Trichloro-s-Triazine

The reaction product from Example 2 should be substituted for the p-n-nonylphenol of Example 1, above, and the procedure thereof used herein to produce the prepared (i.e., reaction) product of this Example.

EXAMPLE VII

Reaction Of p-Phenyl-Co-p-Nonylcalix[8]arene With Trichloro-s-Triazine

The product from Example 3 should be substituted for the p-n-nonylphenol of Example 1, above, and the procedure thereof used herein to produce the prepared (i.e., reaction) product of this Example.

EXAMPLE VIII

Reaction Of p-Phenyl-Co-p-Nonylcalix[8]arene With Trichloro-s-Triazine

The product from Example 4 should be substituted for the p-n-nonylphenol of Example 1, above, and the procedure thereof used herein to produce the prepared (i.e., reaction) product of this Example.

The materials synthesized according to the present invention and illustrated in the above Examples were structurally and physically evaluated. The key structural property of interest was the unequivocal detection of hydroxyl-s-triazines encapsulated within the oligomeric matrix. This evaluation was performed using Fourier Transform Infrared spectroscopy (FTIR). Results of FTIR studies are summarized below in Table II. Moreover, high pressure liquid chromatography was also performed to qualify the number of oligomeric materials present within each experimental sample. Results of this investigation and experimental separation parameters are summarized below in Table III.

Physical testing was concerned with the solubility of encapsulated samples in diesel fuel and thermal stability of the neat sample. Results of solubility studies involving both non-encapsulated materials are summarized below in Table IV. Thermal stability studies were performed using Thermol Gravimetric Analysis (TGA) utilizing a heating rate of 200 deg C/min. TGA summaries of selected samples are provided below in Table V.

TABLE II

Detection Of Encapsulated Hydroxyl-s- Triazine Within An Oligomeric Matrix

| Sample | Phenolic OH Stretch (cm-1) | Phenolic OH Deformation (cm-1) | Cyanuric Acid OH Stretch (cm-1) | Cyanuric Acid OH Deformation (cm-1) |
|---|---|---|---|---|
| Cyanuric Acid | — | — | 3203 | 1390 |
| Example 5 | 3471, 3077, 3030 | 1238 | 3211 | 1389 |
| Example 6 | 3191, 3072, 3040 | 1216 | 3201 | 1390 |
| Example 7 | 3477, 3081 3059 | 1233 | 3206 | 1390 |
| Example 8 | 3444, 3062 3048 | 1226 | 3200 | 1388 |

All FTIR evaluations for experimental samples from each of Examples 5, 6, 7 and 8 were obtained using films produced using THF as the solvent and NaCl discs. FTIR analysis of cyanuric acid was performed by suspending in Nyjol mineral oil.

TABLE III

Summary Of Peak Detection Of Experimental Samples Using HPLC

| Sample Mixture | Components Detected |
|---|---|
| Example 5 | 3 |
| Example 6 | 5 |
| Example 7 | 5 |
| Example 8 | 6 |

The column used for the analysis was non-polar (C18; HS-3 Cl) reverse phase using a sample concentration of 16.0 mg/10 mls THF. The injection volume was routinely 20 microliters and a detection wavelength was 250 nm was used for all samples.

TABLE IV

Maximum Solubility Of Encapsulated Hy-droxy-s-Triazines In Poly[1-Hydroxyl-(2,6-PhenyleneMethylene)]Derivatives In Diesel Fuel

| Sample | Solute Concentration at Turbidity Point (wt %) |
|---|---|
| Example 5 | ~1 |
| Example 6 | 35 |
| Example 7 | 2 |
| Example 8 | 1 |

TABLE V

Thermal Decomposition Of Experimental Precursors And Encapsulated Hydroxyl-s-Triazines Using A Heating Rate Of 200° C./min Under Nitrogen

| Sample | 50 wt % Decomposition Temp. (deg C.) | 90 wt % Decomposition Temp. (deg C.) |
|---|---|---|
| Example 5 | 500 | <800 |
| Example 6 | 560 | <950 |
| Example 7 | 510 | 570 |
| Example 8 | 520 | 580 |

It is readily apparent from structural and physical characterization that a new composition of matter has been invented; namely, encapsulated hydroxyl-s-triazines that exhibit unique and heretofore novel properties.

We claim:

1. A composition of matter comprising a mixture of:

a) p-nonyl calix[8]arene-tri-hydroxyl-s-triazine;

b) p-nonyl calix[8]arene)ether-di-hydroxyl-s-triazine;

c) p-nonyl-calix[8]arene)diether-hydroxyl-s-triazine;

d) p-nonyl-calix[8]arene)triether-s-triazine;

e) p-phenyl-co-p-nonyl-calix[8]arene-tri-hydroxyl-s-triazine;

f) p-phenyl-co-p-nonyl-calix[8]arene)-di-hydroxyl-s-triazine;

g) (p-phenyl-c-p-nonyl-calix[8]arene)diether-s-triazine;

h) (phenyl-co-p-nonyl-calix[8]-arene)triether-s-triazine;

i) di(p-nonyl-calix[8]arene)diether-hydroxyl-s-triazine;

j) (p-nonyl-calix[8]arene)ether-d-(p-nonyl-calix[8]arene)'diether-s-triazine;

k) di(p-phenyl-c-p-nonyl-calix[8]arene)diether-hydroxyl-s-triazine;

l) (p-phenyl-co-p-nonyl-calix[8]arene)ether-di(p-phenyl-co-p-nonyl-calix[8]arene)'diether-s-triazine;

m) tri-(p-nonyl-calix[8]arene)triether-s-triazine;

n) tri(p-phenyl-co-p-nonyl-calix[8]arene)triether-s-triazine;

o) [(p-nonyl-calix[8]arene) -(hydroxyl-s-triazine)]-copolyether;

p) [(p-phenyl-co-p-nonyl-calix[8]arene)-(hydroxyl-s-triazine)]copolyether;

q) [(p-nonyl-calix[8]arene)-(s-triazine)]-starpolyether; and r) [(p-phenyl-co-p-nonyl-calix[8]arene)-(s-triazine)-starpolyether.

2. The composition matter of claim 1, wherein the materials are represented, respectively, by the formulas:

a)

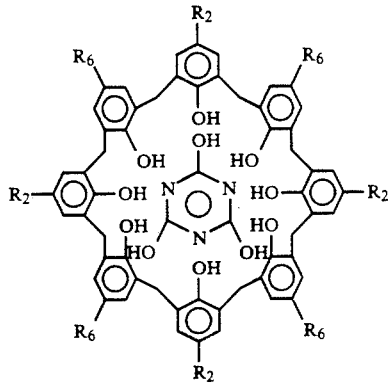

b)

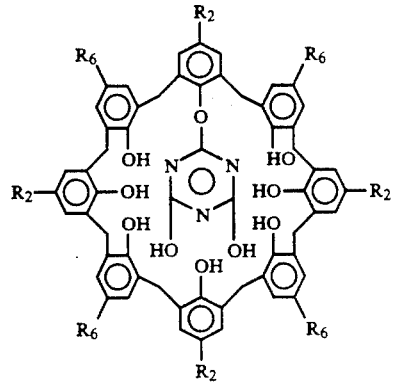

c)
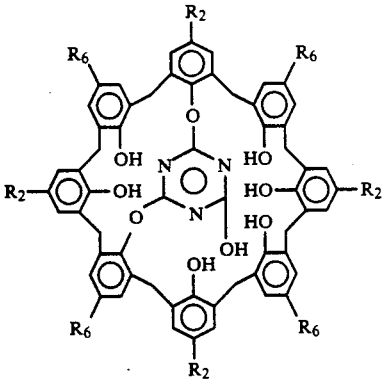
d)
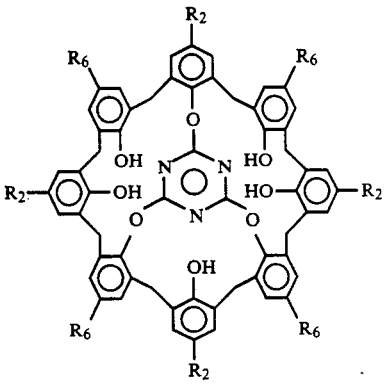
e)
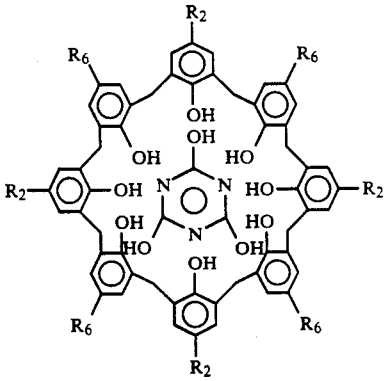
f)
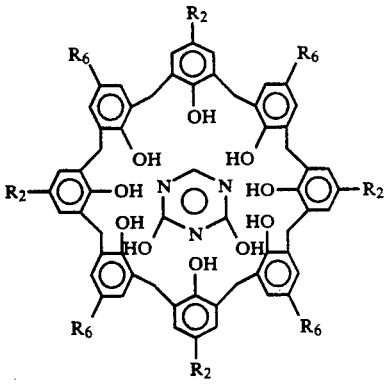
g)
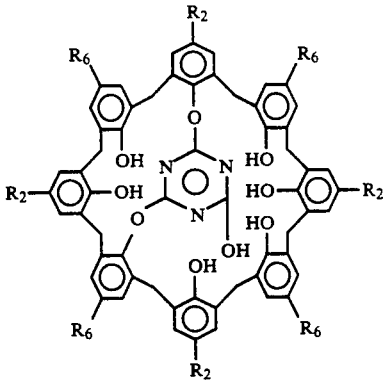
h)
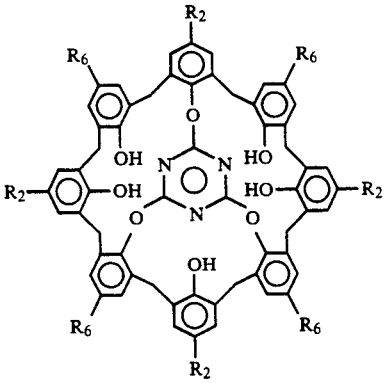
i)
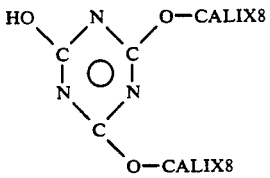
j)
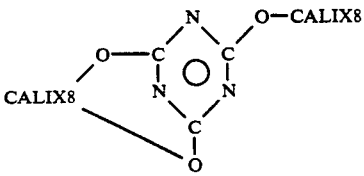
k)
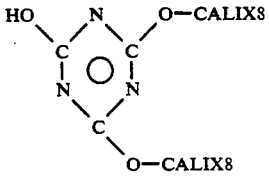

l)
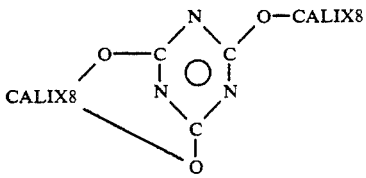
m)
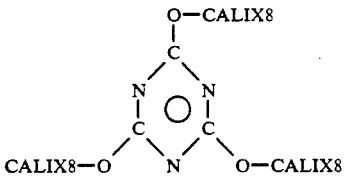
n)
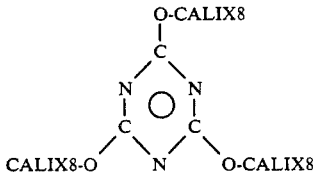
o)
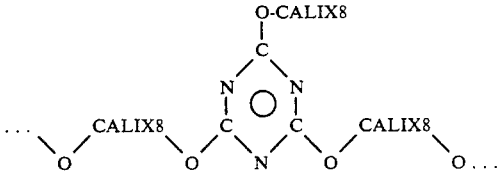
p)
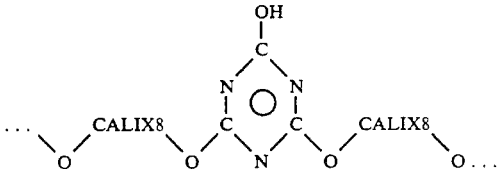
q)
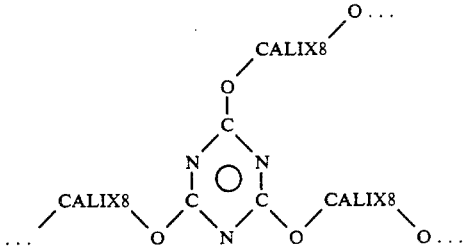
r)
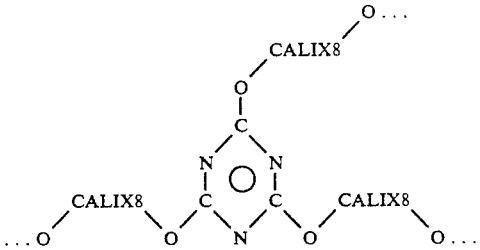
wherein [x varies from 6 to 60; $R_1$], $R_2$[$R_3$, $R_5$,] and $R_6$[, and $R_7$] are each hydrogen or a ($C_1$–$C_{50}$) hydrocarbon[; and $R_4$ is H or a ($C_1$–$C_{10}$)hydrocarbon].
* * * * *